United States Patent [19]

Kibby

[11] Patent Number: 4,533,386

[45] Date of Patent: Aug. 6, 1985

[54] PROCESS FOR PRODUCING ALUMINUM

[75] Inventor: Robert M. Kibby, Lauderdale County, Ala.

[73] Assignee: Process Development Associates, Inc., Florence, Ala.

[21] Appl. No.: 593,921

[22] Filed: Mar. 27, 1984

[51] Int. Cl.[3] ..... C22B 21/02

[52] U.S. Cl. ..... 75/10 R; 75/68 A; 75/24

[58] Field of Search ..... 75/68 A, 10 R, 24

[56] References Cited

U.S. PATENT DOCUMENTS

| | | | |
|---|---|---|---|
| 677,208 | 6/1901 | Hall | 75/68 R |
| 2,451,493 | 10/1948 | Johnson | 75/68 A |
| 3,290,141 | 12/1966 | Johnson | 75/68 R |
| 4,072,512 | 2/1978 | Brusako et al. | 75/68 R |

FOREIGN PATENT DOCUMENTS

| | | | |
|---|---|---|---|
| 717481 | 10/1954 | United Kingdom | 75/68 A |

*Primary Examiner*—Melvyn J. Andrews

[57] ABSTRACT

A carbothermic reduction process for extracting commercially pure aluminum from sources of alumina containing substantial amounts of compounds of elements in the group comprising iron, silicon and titanium is disclosed. The method involves selective reduction of alumina-bearing ores with coal, or other impure sources of carbon containing oxides of elements other than aluminum, to produce a molten slag containing alumina and diminished levels of the impurity oxides, followed by removal of trace impurities from the slag and then recovery of commercially pure aluminum by reaction with substantially pure, carbon, or aluminum carbide derived therefrom, in electrically heated furnaces.

17 Claims, 4 Drawing Figures

PROCESS FOR PRODUCING ALUMINUM

BACKGROUND OF THE INVENTION

1. Field of the Invention

This invention relates to the carbothermic production of aluminum from a process feedstock comprising coal and clay or other oxides of aluminum associated with substantial amounts of the oxides of iron, silicon and titanium.

2. Description of the Prior Art

Many attempts have been made to produce pure aluminum by a carbothermic process to replace the universally used electrolytic process. The processes heretofore disclosed are of two general kinds. Processes of the first kind reduce substantially pure alumina, as made by the Bayer Process, with carbon to produce commercially pure aluminum. Processes of the second kind reduce clay or other mixtures comprising oxides of aluminum, iron, silicon, and titanium to make an aluminum alloy, from which commercially pure aluminum is extracted in a purification step.

Processes of the first kind have been disclosed in U.S. Pat. Nos. 2,829,961; 2,974,032; 3,723,093; 3,971,653; 4,033,757; 4,213,599; 4,216,010; 4,299,619; 4,314,846; and 4,388,107. A carbothermic process which produces commercially pure aluminum from alumina has many potential advantages over the presently used electrolytic process, including lower electrical power consumption, reduced pollution abatement costs and greater production capacity from each furnace. However such processes require pure alumina and pure carbon as feedstock and further require a process preceding carbothermic reduction to extract pure alumina from bauxite, clay or other ores containing aluminum.

Strong interest has been shown in developing processes to produce alumina from clays and other non-bauxitic sources in order to have a domestic source of raw materials in countries having insufficient bauxite reserves, such as the United States. This interest has been expressed in extensive investigations and experimentation by the U.S. Bureau of Mines and certain aluminum producers.

Processes of the second kind have been disclosed in U.S. Pat. Nos. 1,534,316; 3,257,199; and U.K. patent No. GB 2,076,022A. Processes of this kind avoid the pre-reduction steps for separation of iron, silicon and titanium compounds from the aluminum compounds in the ore, but they must provide process steps to separate aluminum from the reduction furnace alloy. These purification steps are difficult and costly and to the present time no commercial production has resulted from processes of the second kind.

One potential advantage of processes which reduce impure ore first and then extract aluminum from an alloy produced in the reduction step is that coal can be burned with oxygen to produce a large part of the overall energy to produce pure aluminum. U.K. patent No. GB 2,076,022A exemplifies this feature. However, no process has yet been disclosed which derives sufficient benefit from the ability to use coal combustion in the reduction furnace to offset the costs of extracting pure aluminum from the reduction furnace alloy.

In a report prepared for the U.S. Department of Energy, "Production of Aluminum-Silicon Alloy and Ferrosilicon and Commercial Purity Aluminum By the Direct Reduction Process", by Marshall J. Bruno, February 1983, there is described a process which burns coal and oxygen in a blast furnace to reduce clay or other oxides of aluminum, silicon, iron and titanium to an alloy comprising aluminum, iron, silicon and titanium. Commercially pure aluminum must be separated from this alloy, as for example by freeze separation of some of the silicon and further electrolytic transfer of pure aluminum from the remainder of the alloy. Separation of aluminum from such alloys by electrolytic means requires that all of the aluminum be transferred from the alloy zone to the pure metal zone.

In U.K. patent No. GB 2,076,022A there is provided a process which burns coal with oxygen to reduce mixtures of clay and alumina to produce an alloy comprising aluminum, iron, silicon and titanium. Commercially pure aluminum is said to be extracted from this alloy by selective solution in and subsequent recovery from a circulating stream of lead. Lead must be removed from the aluminum separated by this process by distillation at very low pressures and high temperatures.

Numerous other patents have issued disclosing methods to extract commercially pure aluminum from the aluminum-iron-silicon-titanium alloy produced by reduction of impure ores and impure carbon sources: for example U.S. Pat. Nos. 3,254,988; 3,257,199; 4,214,955; and 4,411,747. However, none of these has resulted in commercial operation to this date.

In U.S. Pat. No. 4,299,619 there is provided a method for production of aluminum by carbothermic reduction of alumina in a stack type reactor having a first stage in which heat is provided by combustion of carbon with oxygen and a second stage directly therebeneath which is electrically heated to complete the reaction to produce aluminum containing aluminum carbide. However, the carbon required is said to be 3.45 kg. for each kg. of aluminum produced. This carbon must be more pure than the electrode grade carbon presently used in the electrolytic process, which consumes only about 0.5 kg. of carbon per kg. of aluminum produced. This is because, in the method disclosed, all of the impurities in the carbon for heating report to the metal produced.

The extensive activities represented by the patents cited above and the work cited above to develop processes to extract alumina from non-bauxitic sources amply demonstrate the need and desirability of having a process which will achieve the potential benefits of carbothermic reduction using domestic sources of raw materials. And yet, to this date, no process has been disclosed which adequately meets this need. Processes of the first kind must employ steps to extract alumina from non-bauxitic sources which are more capital and energy intensive than the Bayer Process. Processes of the second kind must rely on alloy separation steps which are also excessively capital and energy intensive.

SUMMARY OF THE INVENTION

It is accordingly an object of this invention to provide a process which may use a non-bauxitic ore as feedstock to a carbothermic reduction process for production of commercially pure aluminum, which process does not rely on the separation of aluminum from a reduction furnace alloy.

It is another object of this invention to generate all of the electric power necessary for the process at the plant site using fuel gas produced by the process.

It is a further object of this invention to produce sufficient gas as a by-product of the process that the power plant providing all of the power needs of the plant does not have to be of such high efficiency that it is economically unfeasible when meeting only the power demand of the process.

It is a further object of this invention to provide a process which can use coal as the principal source of carbon for heat generation while meeting the above stated objects of the invention.

It is a further object of this invention to provide a process which is versatile with respect to the choice of feedstock, sources of energy and by-product mix.

Other objects and advantages of the invention will become apparent to persons skilled in the art from the following specification.

The novel process of this invention employs the following steps in combination:

A. A furnace charge comprising oxides of aluminum, silicon, iron, and titanium is heated with coal or a coal fraction to produce a liquid slag corresponding approximately to the chemical compound $Al_4O_4C$ and another molten layer of alloy comprising iron, silicon and titanium.

B. The molten slag from step A is purified to remove the oxides of iron, silicon and titanium remaining in it by contact with a portion of the pure aluminum product of the process.

C. The purified slag from step B is transferred molten to electrically heated furnaces where it is reacted with aluminum carbide or pure coke according to known processes to produce commercially pure aluminum and effluent gases comprising carbon monoxide and gaseous oxides of aluminum.

D. The effluent gases from steps A and C are burned with air to produce heat to generate power for the process.

In the absence of electrolytic action in step B, the impurity oxides in the slag are reduced by the aluminum to produce alumina, which goes into solution in the slag and also to produce alloy comprising aluminum, iron, silicon and titanium, which alloy is periodically removed from the reactor of step B as a by-product of the process. Aluminum is consumed in this reaction and is replaced by a recycle of some of the aluminum produced in step C. The amount of aluminum recycled for this purpose is preferably in the range of 0.4 to 0.6 lbs. for each pound of impurity oxide to be removed from the slag as reduced metal.

The rate at which the reaction between the slag and metal layers in step B occurs can be increased by passing direct electric current between electrodes, one of which contacts the slag layer and the other of which contacts the alloy layer. This electrolytic mass transport enhancement does not have to cause all of the oxides to be reduced by electrolysis to h=effective. Such enhancement of mass transport between the slag and alloy permits the slag purification step to be practiced in smaller furnaces than would be required without such enhancement.

It will be apparent to persons skilled in the art that other methods of enhancing mass transport in the reactor of step B may be employed, for example by injecting non-oxidizing gases into the melt to cause agitation.

In U.S. Pat. No. 1,448,586 there is disclosed a process for producing an alumina based abrasive material, which process includes the steps of mixing aluminum with alumina contaminated with oxides of iron, silicon and titanium and heating to cause the said contaminant oxides to be reduced to their respective metals by the aluminum, and thereafter removing the impurities in reduced form from a frozen mixture of alumina and metallic constituents. This patent also suggests other reducing agents such as the chloride, fluoride or sulphide of aluminum.

In contrast to the teaching of Pat. No. 1,448,586, the present invention reacts a molten layer of slag, comprising alumina and aluminum carbide and containing oxides of iron, silicon and titanium, with a molten layer of an alloy of aluminum, iron, silicon and titanium containing from 25 to 60 percent aluminum, which alloy layer is separated from the alumina-aluminum carbide slag layer by decanting.

Step C of the instant invention can be practiced by any of several prior art processes, for example U.S. Pat. No. 3,971,653, U.S. Pat. No. 4,213,599 or U.S. Pat. No. 4,388,107. The feature of each of these prior art processes which makes them suitable for adaptation to the requirements of the instant invention is the existence in one step or stage in each of said prior art processes of a molten slag comprising alumina and aluminum carbide, which slag is reacted with carbon and/or aluminum carbide to produce a separate molten layer of aluminum containing carbon and aluminum carbide in solution.

In the examples of the preferred embodiments to follow, example 4 of U.S. Pat. No. 4,388,107 provides a stage-by-stage material balance which is adapted to the requirements of the instant invention.

Additional steps may be incorporated into the process to broaden the range of aluminous raw materials that may be used, to separate the iron-silicon-titanium alloy by-product into more useful fractions, and to obtain pure carbon for step C.

For example, the blast furnace of step A can be operated, by adjustment of burden height, to convert part of the silica in the ore to silicon monoxide and the rest to the silicon content of the alloy tapped from the furnace. The silicon monoxide is then burned with air to produce silica and heat for transfer to power plant air and other pre-heat requirements.

Additionally, a freeze purification step can be provided which separates silicon from the iron-silicon-titanium alloy from step B if such separation produces a more marketable product mix.

Coal can be separated by a solvent refining process, for example U.S. Pat. No. 3,240,566, into a pure fraction and a residue fraction. The pure fraction can supply the pure carbon required for step C and the residue fraction can be used in step A.

An important feature of this invention is the method used to purify the slag in step B. In contrast to prior art methods of removing aluminum from alloys, which methods require the transfer of all of the aluminum to be produced from one liquid phase to another, the method of step B of this invention transfers only the impurities from one liquid phase to another. By the time the slag has reached step B, most of the impurities in the ore will have been removed from the slag, but the slag still contains minor amounts of the oxides of silicon, iron and titanium, for, example from 0.1 to 0.2 percent $SiO_2$, 0.3 to 0.5 percent $Fe_2O_3$, and 0.3 to 0.5 percent $TiO_2$. Reduction of such a slag with carbon would not produce commercially pure aluminum, i.e., 99.5+ percent aluminum.

Only the above stated minor amounts of impurity oxides must be removed in step B. In principle, and in some instances practically, it is only necessary to contact the slag in step B with aluminum or an alloy having a composition of from about 25 percent to 60 percent aluminum, the balance of the alloy having iron, silicon and titanium in proportion to their respective amounts in the slag to be purified.

DESCRIPTION OF PREFERRED EMBODIMENTS

Figure 1:
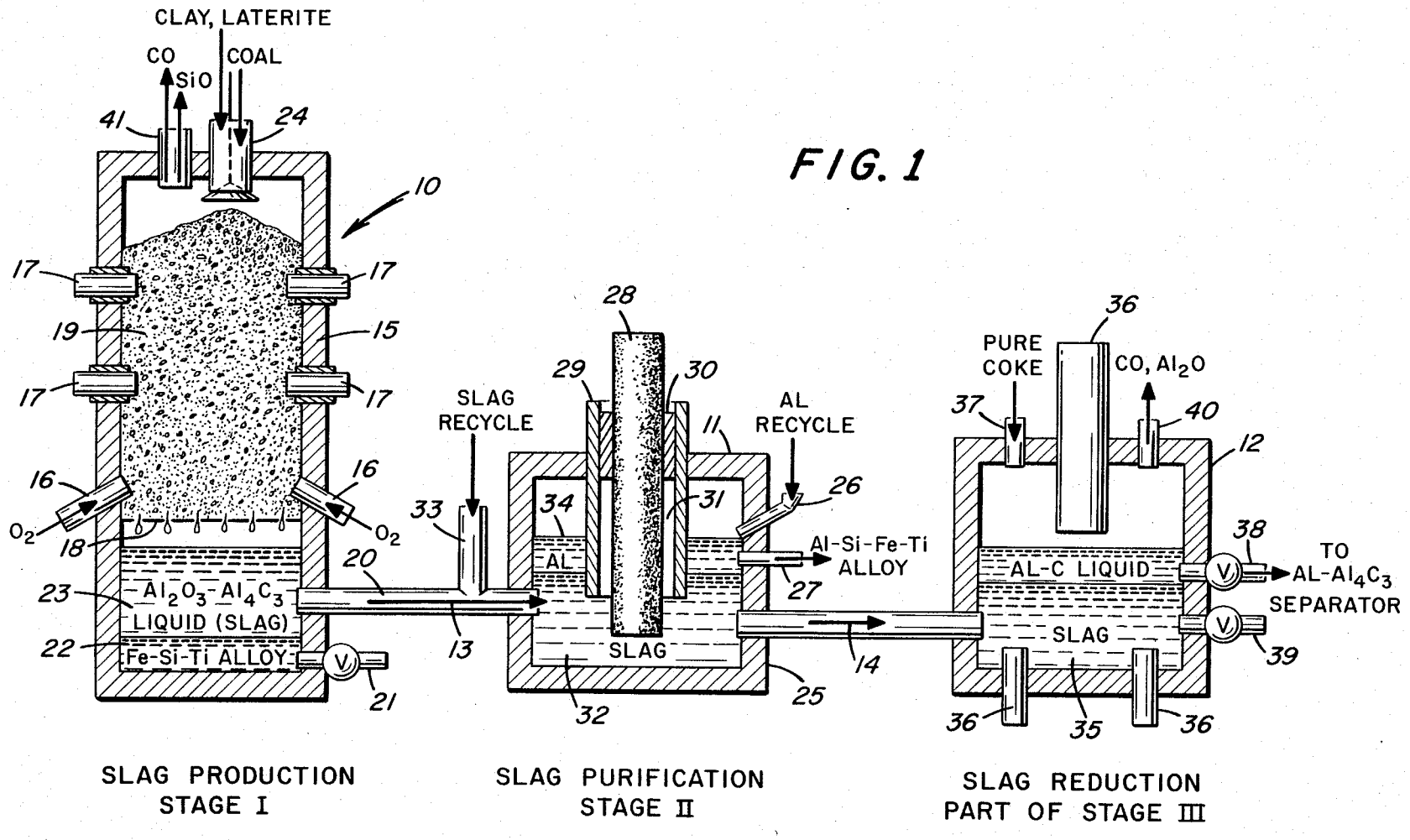
FIG. 1 is a cross sectional view of three furnaces which, in combination, perform the novel process of the invention.

The energy efficient carbothermic process of the present invention for producing commercially pure aluminum from ores which may be non-bauxitic is preferably practiced by providing a stack type reactor 10, as shown in FIG. 1, a slag purifying reactor 11 and a slag reduction reactor 12, with provision to transfer molten slag 13 from reactor 10 to reactor 11 and slag 14 from reactor 11 to reactor 12 as shown.

Reactor 10 is preferably lined with carbon 15 and is provided with ports 16 for admission of oxygen, electrodes 17 for heating power, grate means 18 for support of the furnace burden 19, tapping port 20 for transfer of molten slag stream 13 and tapping port 21 for transfer of alloy layer 22. In certain embodiments, the top of the furnace 10 is closed, except for ports 24 and 41, to provide for the transport of effluent gases, without dilution, to other stages of the process.

Furnace 11 is preferably lined with carbon 25 and is provided with port 26 for the admission of aluminum, tapping port 27 for transfer of impurity bleed alloy, anodic electrode means 28, preferably of carbon, cathodic electrode means 29, preferably of carbon, and electrical insulation therebetween 30. Insulation means 30 are also provided with gas volume controllable vents, not shown, to maintain the desired gas pressure in chamber 31 between the electrode means 28 and 29 so as to prevent slag layer 32 from entering chamber 31.

Port means 33 are provided to allow admission of recycled slag destined for furnace 11.

Reactor 12 may be any of several described in the prior art, for example U.S. Pat. No. 4,388,107. In the preferred embodiment U.S. Pat. No. 4,388,107 provides a zone of slag 35 which may be heated by a combination of electrode means 36 and further provides port means 37 for admission of carbon and recycled solids, port means 38 for tapping metal product, port means 39 for tapping slag for recycle to port means 33 and port means 40 for venting effluent gases to other stages of the process.

In operation, the burden 19 of furnace 10 reacts to provide a molten slag which falls through grate means 18 to rest as a molten layer 23. The reactions in burden 19 of furnace 10 also produce an alloy layer 22 which is immiscible with and lies below slag layer 23. Slag layer 23 is transferred as stream 13 to become the lowermost liquid layer 32 of reactor 11. Layer 32 reacts with aluminum alloy layer 34 to transfer impurity oxides in the slag layer 32 to the alloy layer as reduced metal constituents. Mass transport for this transfer may be enhanced by application of D.C. voltage between electrode means 28 and 29.

The purified slag is transferred molten as stream 14 to a zone 35 in furnace 12 where it is caused to react with carbon and/or aluminum carbide to form aluminum mixed with aluminum carbide as taught in the prior art cited.

Figure 2:
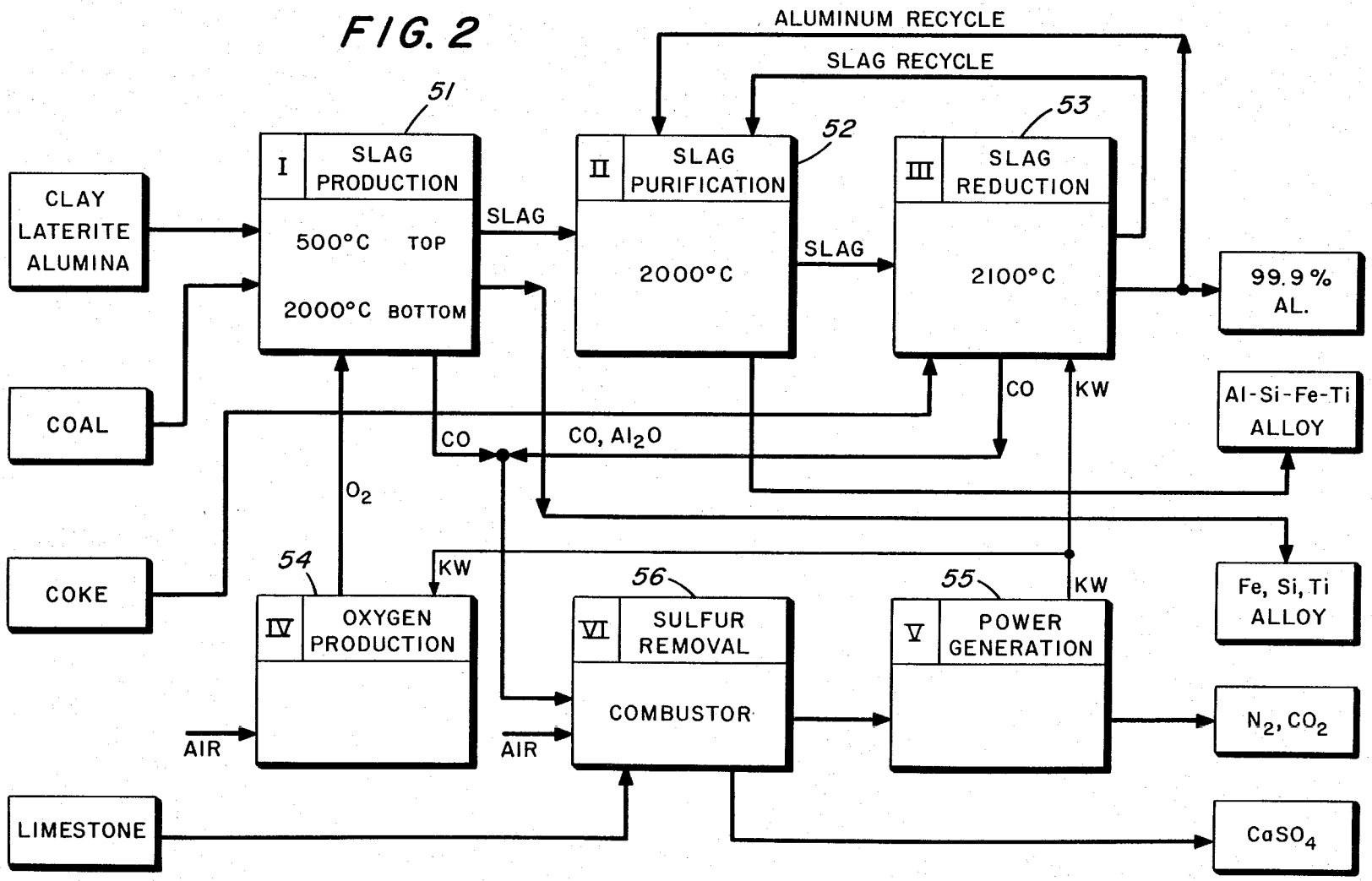
FIG. 2 is a flow diagram illustrating one embodiment of the invention.

A flow sheet showing one embodiment of the instant invention is shown in FIG. 2. Referring to the process steps A, B and C, which have been described briefly in the summary of the invention, step A is practiced in Stage I of the flow sheet (51 on FIG. 2), step B is practiced in Stage II (52), and step C is practiced in Stage III (53). Step D is practiced preferably in two stages V (55) and VI (56) employing known art. Stage VI is an atmospheric fluidized bed combustor which burns fuel gases produced in Stages I and III with air and limestone to produce desulfurized heated combustion product gas, from which electric power is produced by conventional means in Stage V. The power produced in Stage V is sufficient for the separation of oxygen from air in Stage IV (54) by conventional processes and for the requirements of Stage III.

Figure 4:
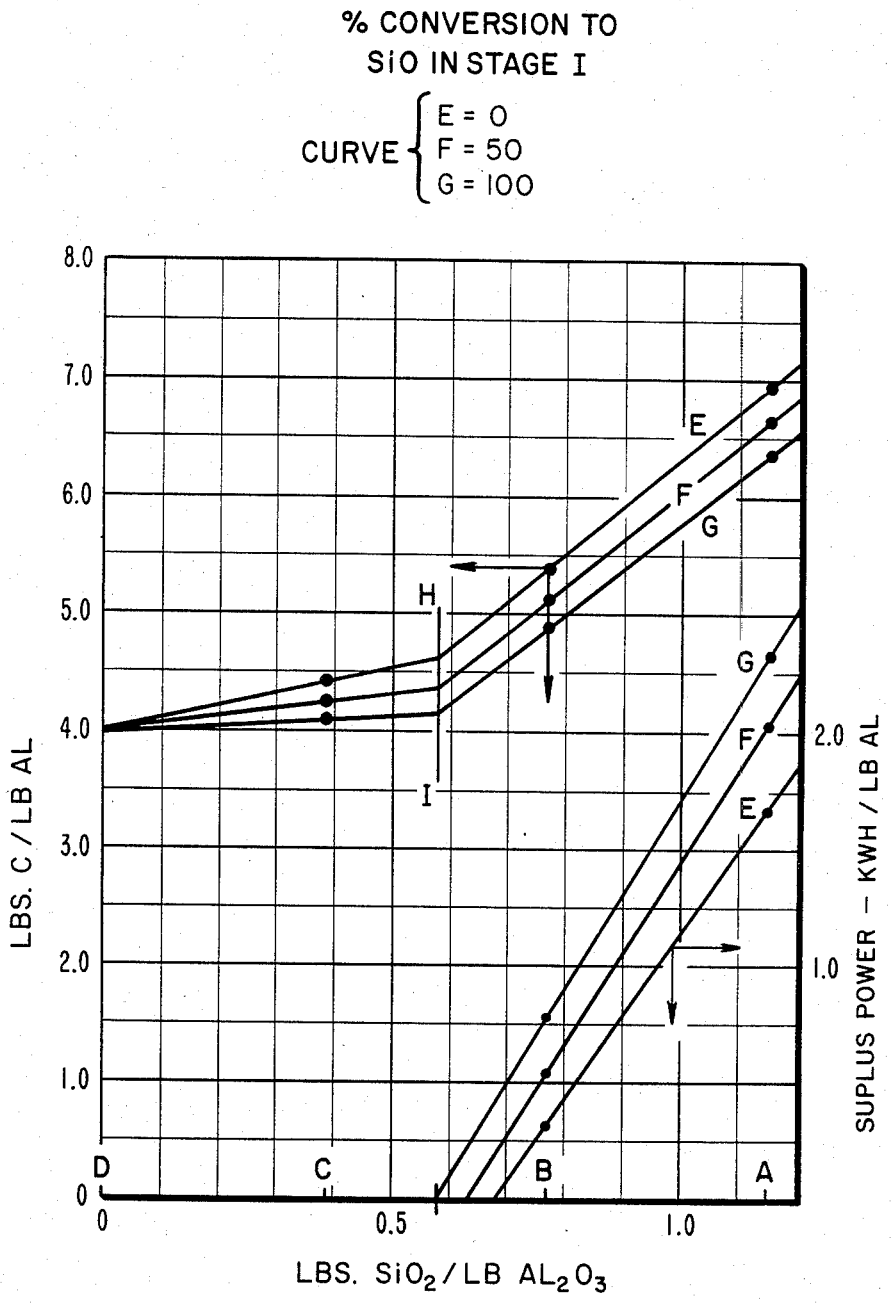
FIG. 4 shows the relationship between the $SiO_2/Al_2O_3$ weight ratio in the process feed and the percent conversion to SiO in Stage I to the carbon consumption and surplus power generation of the process of this invention.

In the embodiment of FIG. 2 the depth of the furnace burden 19 in Stage I is sufficient to result in an exit gas temperature of about 500° C. Under these conditions almost all of the silicon derivable from the aluminum bearing feedstock to the process reports to the lowermost liquid layer of the reactor 10 of Stage I, from which it is tapped as a constituent of by-product Fe-Si-Ti alloy. The aluminum bearing feedstock may be any combination of clay, laterite, alumina, bauxite and other oxides of the group of elements comprising Al, Si, Fe, and Ti. Preferably, the $SiO_2$ to $Al_2O_3$ weight ratio should not exceed from 0.5 to 0.6 if power production in excess of process requirement is not wanted, as illustrated in FIG. 4 and further explained following example 6.

Coal supplies the carbon for heat and reactions in Stage I. Pure coke (electrolytic process anode grade) supplies the carbon for reduction in Stage III.

Figure 3:
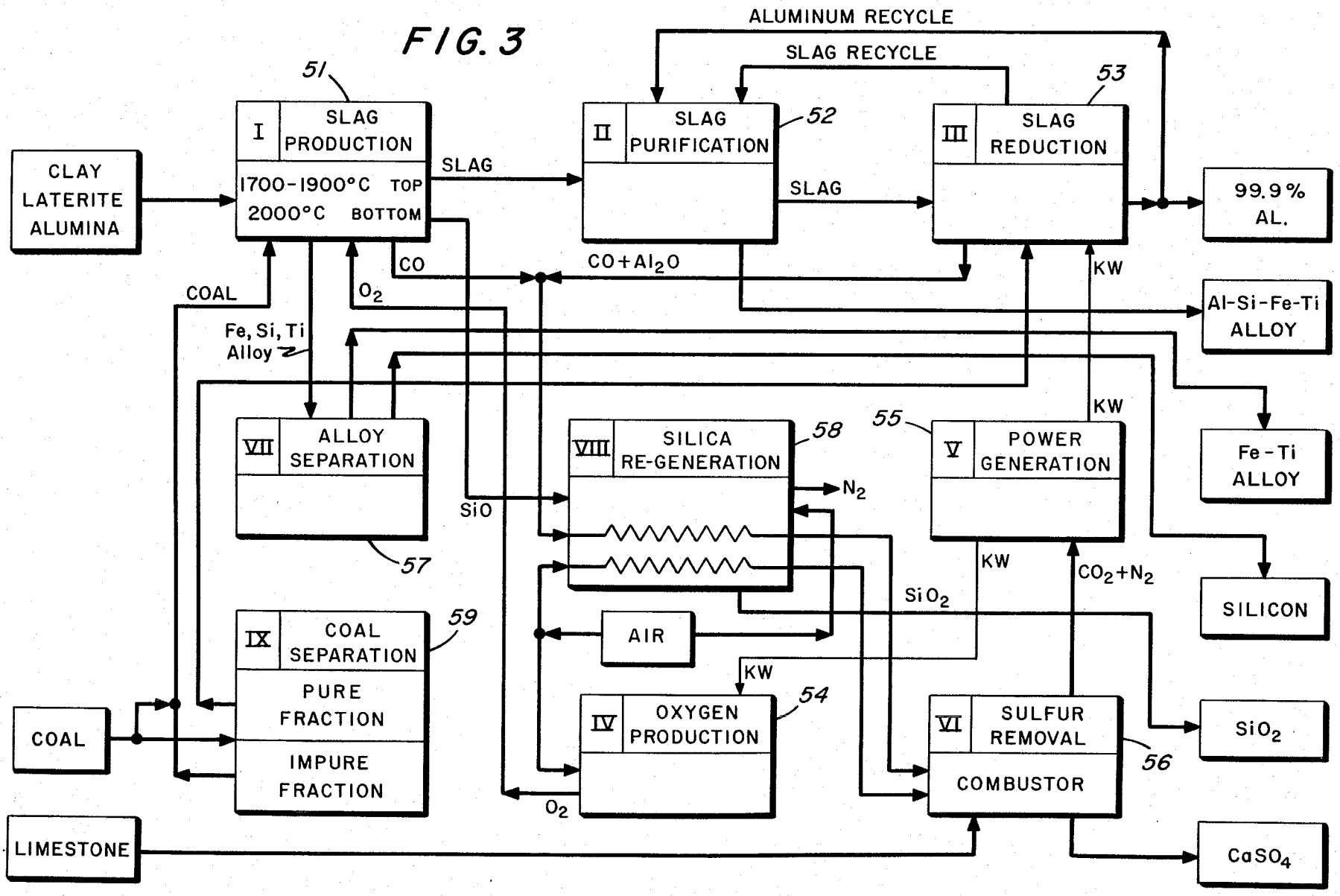
FIG. 3 is a flow diagram illustrating an embodiment of the invention in combination with additional known art to add versatility to the process.

The flow sheet of FIG. 3 shows an embodiment wherein process stages according to known art are added to the same six stages shown on FIG. 2 for the purpose of adding versatility to the process with respect to feedstock, by-product mix, and sources of energy.

In the flow sheet of FIG. 3 the height of charge burden 19 is controlled to allow exit gases to leave the reactor through port means 41 at temperatures in the range 1700° C. to 1900° C. Under these conditions, from 50% to 100% of the silica from the aluminum bearing feedstock is converted to silicon monoxide gas, which reports to Stage VIII (58), where it is burned with air in a conventional pebble bed heat transfer apparatus. Silica produced by this combustion of silicon monoxide becomes one of the by-products of the process. The heat of combustion in Stage VIII is transferred to preheat process fuel gases from stages I and III and combustion air for the generation of electric power in Stages V and VI. Depending on the temperature of exit gases from Stage I within the range 1700° C. to 1900° C. some of the silica leaves Stage I as silicon monoxide and the remainder leaves as a constituent of the iron-silicon-titanium alloy tapped from the furnace.

The iron-silicon-titanium alloy tapped from Stage I may be further separated by selective freezing in Stage VII (57) by known art, for example U.S. Pat. No. 4,256,717 to yield a first fraction comprising substantially pure silicon and a second fraction comprising silicon, iron and titanium In the embodiment represented by the flow sheet of FIG. 3, all of the carbon for the process is derived from coal. This is accomplished in Stage IX (59) by a solvent refining coal separation process according to known art, for example U.S. Pat. No. 3,240,566. The pure fraction of such a process supplies the carbon for reactions in Stage III and the impure fraction supplies fuel and reaction carbon for Stage I. Since the pure carbon fraction for Stage III represents only about ten percent of the total coal used, it is not necessary that all of the coal be processed in Stage IX. The part not processed is fed directly to Stage I.

reduced by the aluminum to their metallic constituents, which go into solution in the aluminum alloy layer 34.

TABLE I

RAW MATERIALS BASIS FOR MATERIAL BALANCES - WEIGHT PERCENT

| | $Al_2O_3$ | $SiO_2$ | $Fe_2O_3$ | $TiO_2$ |
|---|---|---|---|---|
| Alumina | 100 | 0 | 0 | 0 |
| Clay | 38 | 43 | 2 | 2 |
| Laterite | 34 | 7 | 30 | 5 |
| Coal Ash | 31 | 51 | 11 | 2 |

| | Fixed Carbon | Sulfur | Volatile | Ash |
|---|---|---|---|---|
| Coal | 74 | 1 | 18 | 4 |
| Coke | 100 | 1 | 0 | 0 |

Coal has heating value of 14,550 Btu/lb.

TABLE II

MATERIAL AND ENERGY BALANCE RESULTS
Basis: 1.00 lb. 99.9% Al. Product

| EXAMPLE NUMBER | 1 | 2 | 3 | 4 | 5 | 6 |
|---|---|---|---|---|---|---|
| % Conversion to SiO in Stage I | 0 | 100 | 50 | 100 | 100 | 100 |
| MATERIALS INPUT-Lbs. | | | | | | |
| Alumina* | 1.9 | 0 | .6 | 0 | 0 | 0 |
| Clay* | 0 | .6 | 2.8 | 4.2 | 4.2 | 4.2 |
| Laterite* | 0 | 3.4 | 0 | 0 | 0 | 0 |
| Limestone | .26 | .35 | .39 | .48 | .37 | .12 |
| Coal: | | | | | | |
| For process | 4.3 | 6.1 | 6.1 | 5.3 | 6.5 | 2.2 |
| For surplus KW | 0 | .2 | .8 | 3.2 | 0 | 0 |
| Total coal | 4.3 | 6.3 | 6.9 | 8.5 | 6.5 | 2.2 |
| Coke | .4 | 0 | 0 | 0 | 0 | 0 |
| POWER PURCHASED: Kwh | 0 | 0 | 0 | 0 | 0 | 6.1 |
| BY-PRODUCTS: Lbs. | | | | | | |
| Silicon | 0 | 0 | .15 | 0 | 0 | 0 |
| Alloy (Fe/Si/Ti) | .03 | 1.21 | .45 | .13 | .11 | .11 |
| Alloy (Al/Fe/Si/Ti) | .01 | .01 | .01 | .01 | .01 | .01 |
| $CO_2$ | 8.2 | 10.9 | 12.0 | 14.8 | 11.3 | 3.8 |
| $SiO_2$ | 0 | .73 | .73 | 2.35 | 2.20 | 2.18 |
| $CaSO_4$:$CaCO_3$ | .30 | .40 | .43 | .54 | .41 | .14 |
| SURPLUS POWER: Kwh | 0 | .2 | .6 | 2.4 | 0 | 0 |
| AUXILLIARIES PRODUCTION: | | | | | | |
| Oxygen-lbs. | 1.8 | 4.6 | 5.2 | −6.8 | 0 | 0 |
| Electricity-Kwh | 4.5 | 5.2 | 5.7 | 7.8 | 8.5 | 2.4 |

*Calcined

The preferred embodiments of this invention are further illustrated in six examples. Mass and energy balances have been calculated for each of these examples based on raw material properties shown in Table I. The results of these calculations are shown in Table II.

EXAMPLE 1

The flow sheet of FIG. 2 applies to example 1. For each pound of 99.9% aluminum produced, 1.9 lbs. metallurgical grade alumina and 4.3 lbs. of coal are charged to the top of stack reactor 10 of Stage I and 1.8 lbs. of oxygen is admitted through tuyeres 16. The depth of the furnace burden 19 is maintained to achieve a temperature of the gases leaving Stage I at about 500° C. By-product iron-silicon-titanium alloy in the amount of 0.03 lbs., having weight proportions Fe:Si:Ti equal to 0.4:2.7:0.3, is tapped from the lowermost liquid level of the reactor of Stage I. Slag produced in Stage I is transferred to the reactor of Stage II where it is mixed with slag recycled from Stage III. Slag is recycled from Stage III whenever calcium oxide is used in Stage III to reduce the melting point of the slag.

The oxides of silicon, iron and titanium in the slag layer 32 of the reactor of Stage II come in contact with an aluminum alloy layer 34 above the slag layer and are For each pound of 99.9% Al product, about 0.005 lbs. of aluminum is recycled to the metal layer 34 of Stage II through port 26 and 0.01 lbs. of aluminum-silicon-iron-titanium alloy is tapped through port 27, said alloy having weight proportions Al:Si:Fe:Ti equal to 0.34:0.11:0.44:0:46.

The purified slag from layer 32 of the reactor of Stage II is transferred to a slag zone 35 in the reactor 12 of Stage III, where it is reacted with 0.4 lbs. petroleum coke and/or with aluminum carbide produced therefrom in Stage III to produce aluminum mixed with aluminum carbide. Stage III is completed to produce 1 lb. of 99.9% aluminum according to prior art methods, for example U.S. Pat. No. 4,388,107, example 4.

Fuel gas comprising carbon monoxide, aluminum monoxide and a minor amount of silicon monoxide is transferred via conduits 40 and 41 to mix with air and 0.26 lbs. of limestone in the fluidized bed combustor of Stage VI. Heated combustion products from Stage VI produce 4.5 kwh of power in Stage V at a thermal efficiency of 33%. Of this power, 3.7 kwh is used in Stage III, 0.3 kwh is used for the production of oxygen, and 0.5 kwh is used for other plant requirements.

The sulfur in the coal reacts with 0.26 lbs. of limestone and leaves the system as a mixture of calcium carbonate and calcium sulfate All of the above weights are based on one lb. of 99.9% aluminum.

EXAMPLE 2

This example uses all of the process stages shown on FIG. 3, except alloy separation Stage VII (57). For each pound of 99.9% Al produced, 0.6 lbs. of calcined clay, 3.4 lbs. of calcined laterite and 5.9 lbs. of coal are fed to the reactor of Stage I, which is operated at a bed depth to maintain an off-gas temperature of from 1800° C. to 1900° C. The silica content of the clay and laterite reports as silicon monoxide to Stage VIII (58), where it is burned with air, eventually leaving the system as 0.73 lbs. of silica pebbles.

Coal is separated in Stage IX (59) to provide 0.4 lbs. of a pure fraction of carbon and 5.9 lbs. of an impure fraction. The pure fraction is used in Stage III of the process. From the furnace of Stage I is tapped 1.21 lbs. of iron-silicon-titanium alloy having weight proportions Fe:Si:Ti equal to 100.5:5.7:14.4, which alloy leaves the system without further separation. The slag purification Stage II produces 0.01 lb. of aluminum-silicon-iron-titanium by-product alloy of the same composition as in example 1.

Stages V and VI, with fuel gas and air pre-heat from Stage VIII produce 5.2 kwh of electric power at a thermal efficiency of 33%. Of this power, 3.7 kwh is used in Stage III, 0.8 kwh is used to produce 4.6 lbs. of oxygen, 0.5 kwh is used for other plant requirements, and 0.2 kwh is available for sale. The sulfur in the 6.3 lbs. of coal fed to the system reacts with 0.35 lbs. of limestone and leaves the system as a mixture of calcium carbonate and calcium sulfate The above production and consumption weights are for 1 lb. of 99.9% aluminum.

EXAMPLE 3

This example uses all of the process stages shown on FIG. 3. For each pound of 99.9% aluminum produced, the reactor of Stage I is fed 0.6 lbs. of alumina, 2.8 lbs. of calcined clay, 6.5 lbs. of coal and 5.2 lbs. of oxygen. The bed depth in the reactor of Stage I is adjusted to allow about 50% of the silica in the clay to leave Stage I as silicon monoxide and 50% to report as silicon in 0.6 lbs. of iron-silicon-titanium alloy having weight proportions Fe:Si:Ti equal to 17.1:40.2:2.6, which alloy is tapped from Stage I. This alloy is further separated in Stage II to yield 0.15 lbs. of silicon and 0.45 lbs. of iron-silicon-titanium alloy having weight proportions Fe:Si:Ti equal to 17.1:25.7:2.6.

The silicon monoxide leaving Stage I reports to Stage VIII, where it reacts with air to produce 0.73 lbs. of silica pebbles and heat for exchange with fuel and air for Stages V and VI.

Stages V and VI produce 5.7 kwh of electric power at a thermal efficiency of 33%. Of this power, 3.7 kwh is used for Stage III, 0.9 kwh is used for the production of oxygen, 0.5 kwh is used for other plant requirements, and 0.6 kwh is available for sale.

EXAMPLE 4

This example uses all of the process stages shown on FIG. 3 except alloy separation Stage VII. For each pound of 99.9% aluminum produced, 4.2 lbs. of clay, 8.1 lbs. of coal and 6.8 lbs. oxygen are fed to the reactor of Stage I, which is operated at a bed depth to maintain an off-gas temperature high enough to convert all of the silica in the clay to silicon monoxide. From the furnace of Stage I is tapped 0.13 lbs. of alloy having weight proportions Fe:Ti equal to 9.1:4.3.

The silicon monoxide from Stage I reports to Stage VIII where it reacts with air to produce 2.35 lbs. of silica pebbles and heat for exchange with fuel and air for Stages V and VI.

Stages V and VI produce 7.8 kwh of electric power, of which 3.7 kwh is used for Stage III, 1.2 kwh is used for the production of 6.8 lbs. of oxygen, 0.5 kwh is used for other plant requirements and 2.4 kwh is available for sale. The sulfer in the coal fed to the process reacts with 0.48 lbs. of limestone and leaves the system as a mixture of calcium carbonate and calcium sulfate.

EXAMPLE 5

This example is the same a example 4 except that the heat required for Stage I is supplied by electric power generated at the plant site. The power is delivered to the reactor of Stage I through electrode means 17 (FIG. 1). This reduces the coal rate to 6.5 lbs. per lb. aluminum produced and eliminates the need for oxygen production Stage IV.

The on-site power plant has the capacity to deliver 8.5 kwh per pound of aluminum product.

EXAMPLE 6

This example is the same as example 5 except that all power in excess of the power that can be generated from fuel gases produced by the process is purchased. This reduces the coal rate to 2.2 lbs. per lb. aluminum produced and it reduces the need for on-site power generating capacity to 2.4 kwh per pound aluminum produced.

Material and energy balance calculations have been made to show the effects of changing the silica-to-alumina weight ratio in the feed to Stage I of the process and the effects of changing the percent conversion to silicon monoxide in Stage I. The results of these calculations are shown in FIG. 4, where the letters A, B, C and D locate the ratios for which the calculations were made. The lines labeled E, F and G denote respectively 0%, 50% and 100% conversion to silicon monoxide in Stage I. The line H I denotes the silica-to-alumina ratio above which surplus power may be generated. For example, at a silica-to-alumina ratio in Stage I feed of about 0.77, corresponding to point B, the carbon consumption of the process is 5.4 lbs. per pound of aluminum produced and the potential surplus power at 33% power plant efficiency is about 0.30 kwh per lb. aluminum produced, when none of the silica in Stage I feed is converted to silicon monoxide. At the same silica-to-alumina ratio in the feed, but with 100% conversion to silicon monoxide in Stage I, the carbon consumption is about 4.9 lbs. and the potential surplus power is about 0.76 kwh for each pound of aluminum produced.

Whether it is better to derive heat for Stage I from fuel and oxygen as in example 4 or from electricity generated on-site as in example 5 depends primarily on the relative costs to build power plants and oxygen plants. For example, the option to heat Stage I electrically, as in example 5, requires less investment than the option to heat Stage I by combustion of coal with oxygen, as in example 4, whenever the ratio of the cost of power facilities in dollars per kilowatt to the cost of oxygen plants in dollars per annual ton of oxygen is less than about 10.

Example 6 shows that, whenever power can be purchased economically, for example from hydro-electric plants, the coal rate for producing commercially pure aluminum from clay can be reduced to 2.2 lbs. of coal per lb. of aluminum produced and the on-site power generating capacity can be reduced to 2.4 kwh per pound of aluminum produced.

These six examples show the wide variety of options which are available with the process of this invention with respect to raw materials, by-product mix, and energy sources.

It should be understood that the invention is not to be limited by the foregoing embodiments but includes all variations that would occur to one skilled in the art as defined by the appended claims.

What is claimed is:

1. In a carbothermic process for producing aluminum metal including the step of reacting carbon bearing materials with molten slag comprising alumina and aluminum carbide, a method for producing said slag, the method comprising the following steps:

A. in a first reaction zone, heating a mixture containing sources of alumina, silica, iron oxide, titanium oxide and carbon to produce a first non-metallic melt, a reaction zone off-gas mixture containing silicon monoxide and carbon monoxide and a first molten metallic alloy containing a part of the iron, silicon and titanium derivable by reduction of said heated mixture with carbon;

B. in a second reaction zone, reacting the first non-metallic melt produced in step A with aluminum to reduce oxides of iron, silicon and titanium in said first non-metallic melt to their metallic states, thereby forming a second molten alloy containing aluminum, iron, silicon, and titanium and thereby converting said first non-metallic melt to a purified second non-metallic melt; and C. recovering the purified second non-metallic melt from step B to provide said molten slag comprising alumina and aluminum carbide.

2. The method of claim 1, wherein said reaction between said non-metallic melt and aluminum in step B is added by the passage of electric direct current between an alloy layer containing said aluminum and a layer of said non-metallic melt.

3. The method of claim 1, wherein at least part of the heat required to cause the chemical reactions in step A to occur is provided by the combustion of coal in said first reaction zone.

4. The method of claim 1, wherein the source of carbon for step A is coal containing oxides of iron, silicon and titanium.

5. The method of claim 1, wherein coal is separated to an impure fraction containing most of the oxides of iron, silicon and titanium in the coal and a pure fraction, and the impure fraction is the source of carbon for reactions and heat generation in said first reaction zone.

6. The method of claim 1, wherein the amount of silicon monoxide leaving said first reaction zone is regulated by adjusting the depth of the reaction bed in said first reaction zone.

7. The method of claim 1, wherein said silicon monoxide is reacted with air to produce silica and heat.

8. The method of claim 1, wherein said aluminum in step B is from 25 to 60 weight percent of said alloy of aluminum, iron, silicon and titanium and is maintained within said weight percentage range by adding aluminum to said alloy at a rate of from 0.4 to 0.6 pounds for each pound of impurity oxide to be removed from said first non-metallic melt and portions of said alloy are removed from said second reaction zone.

9. A carbothermic process for producing aluminum containing aluminum carbide from alumina, silica, iron oxide and titanium oxide bearing materials, comprising the following steps:

A. bringing charge materials containing sources of alumina, silica, iron oxide, titanium oxide and carbon to a temperature sufficiently high to produce silicon monoxide gas, a first molten slag containing alumina and aluminum carbide and a first molten metallic alloy containing a part of the iron, silicon and titanium derivable by reduction of said charge materials with carbon;

B. purifying said first molten slag by reaction with aluminum, whereby oxides of iron, silicon and titanium contained in said first slag produced in step A are reduced to form a second molten metallic alloy containing aluminum, iron, silicon and titanium and said first molten slag is thereby converted to a purified second slag;

C. reducing said second slag produced in step B by reaction with a source of substantially pure carbon to produce aluminum containing aluminum carbide; and D. recovering product aluminum containing aluminum carbide from step C.

10. The carbothermic process of claim 9, wherein said reaction between said molten slag and aluminum in step B is aided by the passage of electric direct current between an alloy layer containing said aluminum and a layer of said molten slag.

11. The carbothermic process of claim 9, wherein at least part of the heat to cause the chemical reactions in step A to occur is provided by the combustion of coal in the reaction zone of step A.

12. The carbothermic process of claim 9, wherein the source of carbon for step A is coal and the source of carbon for step C is petroleum coke.

13. The carbothermic process of claim 9, wherein coal is separated to an impure fraction containing most of the oxides of iron, silicon and titanium in the coal and a pure fraction, the impure fraction supplying a source of carbon for the reactions and generation of heat in step A and the pure fraction supplying a source of carbon for step C.

14. The carbothermic process of claim 9, wherein the amount of silicon monoxide leaving the reaction zone of step A is regulated by the depth of the reaction bed in said zone.

15. The carbothermic process of claim 9, wherein said aluminum in step B is from 25 to 60 weight percent of said alloy of aluminum, iron, silicon and titanium and is maintained within said weight percentage range by adding alumina to said alloy at a rate of from 0.4 to 0.6 pounds for each pound of impurity oxide to be removed from said first molten slag portions of said alloy are periodically removed from the reaction zone of step B.

16. The carbothermic process of claim 9, wherein the silicon monoxide evolved from the reaction zone of step A is reacted with air to produce silica and heat.

17. A carbothermic process for producing aluminum metal from alumina, silica, iron-oxide and titanium-oxide bearing materials, comprising the following steps:

A. heating a mixture containing sources of alumina, silica, iron-oxide and titanium-oxide with coal containing oxides of iron, silicon and titanium to a temperature sufficiently high to produce silicon monoxide gas, a first molten slag containing alumina and aluminum carbide and a first molten metallic alloy containing a part of the iron, silicon and titanium derivable by reduction of said mixture with carbon;

B. purifying said first molten slag by bringing it into contact with a second alloy of aluminum, iron, silicon and titanium containing aluminum in the range 25 to 60 weight percent of said second alloy, whereby oxides of iron, silicon and titanium contained in said first molten slag are reduced to their metallic states and dissolved in said second alloy and said first molten slag is thereby converted to a purified second slag;

C. reducing said purified second slag with carbon and aluminum carbide derived from a pure source of carbon, such as petroleum coke; and D. recovering aluminum metal from step C, substantially as described.

* * * * *

UNITED STATES PATENT AND TRADEMARK OFFICE

CERTIFICATE OF CORRECTION

PATENT NO. : 4,533,386

DATED : August 6, 1985

INVENTOR(S) : Robert M. Kibby

It is certified that error appears in the above-identified patent and that said Letters Patent is hereby corrected as shown below:

Column 3, line 53, "h=" should read -- be --.

Claim 2, line 3, "added" should read -- aided --.

Claim 15, line 5, "alumina" should read -- aluminum --.

Signed and Sealed this

*Twelfth* Day of *November 1985*

[SEAL]

*Attest:*

DONALD J. QUIGG

*Attesting Officer*

*Commissioner of Patents and Trademarks*